US007176952B2

(12) United States Patent
Ishida et al.

(10) Patent No.: US 7,176,952 B2
(45) Date of Patent: Feb. 13, 2007

(54) FIXING DEVICE AND IMAGE FORMING APPARATUS

(75) Inventors: Masami Ishida, Iwatsuki (JP); Yoshio Matsukura, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 132 days.

(21) Appl. No.: 11/024,811

(22) Filed: Dec. 30, 2004

(65) Prior Publication Data

US 2005/0253096 A1 Nov. 17, 2005

(30) Foreign Application Priority Data

May 14, 2004 (JP) ..... 2004-144546

(51) Int. Cl.
*G03G 15/20* (2006.01)

(52) U.S. Cl. ..... 347/156; 399/122

(58) Field of Classification Search ..... 347/155, 347/156; 399/122, 320, 322
See application file for complete search history.

(56) References Cited

U.S. PATENT DOCUMENTS 4,541,705 A * 9/1985 Knechtel ..... 399/320
5,408,301 A * 4/1995 Tokishige et al. ..... 399/69
5,995,797 A * 11/1999 Shigeta et al. ..... 399/322
6,512,914 B2 * 1/2003 Kabashima ..... 399/341
6,574,448 B2 * 6/2003 Mochimaru et al. ..... 399/309
6,690,901 B2 * 2/2004 Katsuyama et al. ..... 399/107
2002/0015602 A1 * 2/2002 Mochimaru et al. ..... 399/309
2002/0098022 A1 * 7/2002 Kabashima ..... 399/341
2003/0230561 A1 * 12/2003 Kagawa et al. ..... 219/216
2004/0052547 A1 * 3/2004 Matsuura et al. ..... 399/119
2004/0131403 A1 * 7/2004 Nakamura et al. ..... 399/341
2005/0061792 A1 * 3/2005 Kagawa et al. ..... 219/216
2005/0123327 A1 * 6/2005 Tateishi et al. ..... 399/325

FOREIGN PATENT DOCUMENTS

JP 6-110274 A 4/1994
JP 10-151832 A 6/1998

* cited by examiner

*Primary Examiner*—Huan Tran
(74) *Attorney, Agent, or Firm*—Sughrue Mion, PLLC

(57) ABSTRACT

A fixing device to be installed in an image forming apparatus includes a housing for defining the fixing device. In the housing, a heating member which heats a recording medium onto which a toner image is transferred to fix the image and a pressing member which is brought into press contact with the heating member are provided. In the housing, a first conveyance path and a second conveyance path which has a path different from the first conveyance path is formed. A switching member which switches a destination of the recording medium to the first conveyance path or the second conveyance path is arranged in the housing. As a result, when the image recording medium is sent to a paper reversing device installed in the image forming apparatus, the length of a conveyance path extending to the switching member can be shortened.

17 Claims, 8 Drawing Sheets

FIXING DEVICE AND IMAGE FORMING APPARATUS

CROSS-REFERENCE TO RELATED APPLICATION

This application claims priority under 35 USC 119 from Japanese Patent Application No. 2004-144546, the disclosure of which is incorporated by reference herein.

BACKGROUND OF THE INVENTION

1. Field of the Invention

The present invention relates to a fixing device, which fixes an image on a recording medium by a method of fixing the image with heat and an image forming apparatus in which the fixing apparatus is installed.

2. Description of the Related Art

Some image forming apparatus such as a printer or a copying machine reverses a sheet of paper on which an image is fixed by a fixing device to fix the image on the other surface (surface on the back of the surface on which the image is fixed). At this time, a minimum function for forming an image is given to an apparatus body, and a device (paper reversing device) for reversing a sheet of paper is optionally arranged in the apparatus.

The paper reversing device serving as an optional device is detachably loaded on the image forming apparatus body. A switching gate arranged near a paper delivery unit of the image forming apparatus body is switched to guide a sheet of paper to the paper delivery unit or a reversing roller of the paper reversing device (Japanese Patent Application Laid Open No. 6-110274).

However, in the image forming apparatus described in Japanese Patent Application Laid Open No. 6-110274, a switching gate for switching a destination for conveyance of a sheet of paper to the paper delivery unit or the reversing roller of the paper reversing device is arranged in the paper reversing device. For this reason, when a sheet of paper is conveyed to the paper reversing device, a path length of the sheet of paper to the switching gate becomes long. As a result, time required for a printing process (throughput) disadvantageously becomes long.

SUMMARY OF THE INVENTION

The present invention provides an apparatus which reduces a throughput by shortening a path length of conveyance of a sheet of paper.

A first aspect of the invention is to provide a fixing device including: a heating member which is installed in an image forming apparatus, which is arranged in a housing for defining the fixing device, and which heats a recording medium onto which a toner image has been transferred to fix the image; a pressing member which is brought into press contact with the heating member; a first conveyance path which is formed in the housing and on which the recording medium, on which the image is fixed by the heating member and the pressing member, is conveyed; a second conveyance path which is formed in the housing, which has a path different from the first conveyance path, and on which the recording medium, on which the image is fixed by the heating member and the pressing member, is conveyed; and a switching member which switches a destination of the recording medium to either one of the first conveyance path and the second conveyance path.

According to the above aspect of the invention, the heating member which heats a recording medium to fix a toner image on a recording medium and a pressing member which is brought into press contact with the heating member are arranged in the housing, the recording medium on which the image is fixed by the heating member and the pressing member is conveyed such that the switching member switches a destination for conveyance to any one of the first conveyance path formed in the housing and the second conveyance path formed independently of the first conveyance path in the housing.

Since the destination can be switched in the fixing device, for example, when a sheet of paper having a surface on which an image is formed is conveyed to the second conveyance path and sent to the paper reversing device, a path length of conveyance of the sheet of paper to the switching member can be shortened. Therefore, a throughput is improved. In addition, for example, even though another conveyance path is not formed on the downstream side of the fixing device, a delivery path of the sheet of paper can be changed by simplex (single-side)/duplex (double-side) printing or the like.

A second aspect of the invention is to provide an image forming apparatus including: a toner image carrier having a surface on which a toner image is formed; a recording medium storage unit which stores a plurality of sheets of image recording media; a main conveyance unit which takes out one sheet of image recording medium from the storage unit and conveys the recording medium to bring the recording medium into contact with a surface of the toner image carrier on which the toner image is formed; a transfer unit which transfers the toner image from the toner image carrier to the recording medium; and a fixing device which receives the image recording medium onto which the toner image has been transferred and fixes the toner image on the image recording medium, wherein the fixing device includes: a heating member which is installed in an image forming apparatus, which is arranged in a housing for defining the fixing device, and which heats a recording medium onto which a toner image has been transferred to fix the image, a pressing member which is brought into press contact with the heating member, a first conveyance path which is formed in the housing and on which the recording medium, on which the image is fixed by the heating member and the pressing member, is conveyed, a second conveyance path which is formed in the housing, which has a path different from the first conveyance path, and on which the recording medium, on which the image is fixed by the heating member and the pressing member, is conveyed, and a switching member which switches a destination of the recording medium to either one of the first conveyance path and the second conveyance path.

The image forming apparatus may further include a paper reversing device. The paper reversing device may be connected to the second conveyance path to receive an image recording medium conveyed to the second conveyance path, and may return the image recording medium to the main conveyance path such that a surface of the image recording medium, on an opposite side thereof the toner image has fixed, is brought into contact with a surface of the image carrier, on which surface a toner image is formed.

BRIEF DESCRIPTION OF THE DRAWINGS

Preferred embodiment of the present invention will be described in detail based on the following figures, wherein:

FIGS. 7A and 7B are side views of a solenoid in the fixing device according to the embodiment of the invention, wherein FIG. 7A shows a state before the solenoid presses an operation piece and FIG. 7B shows a state in which the solenoid presses the operation piece;

FIGS. 8A and 8B are sectional views of a projecting portion of the fixing device according to the embodiment of the invention, wherein FIG. 8A shows a state in which a projecting portion 176 is brought into contact with a rib 178 and FIG. 8B shows a state in which a projecting portion 180 is brought into contact with a rib 182.

DETAILED DESCRIPTION OF THE INVENTION

Figure 1:
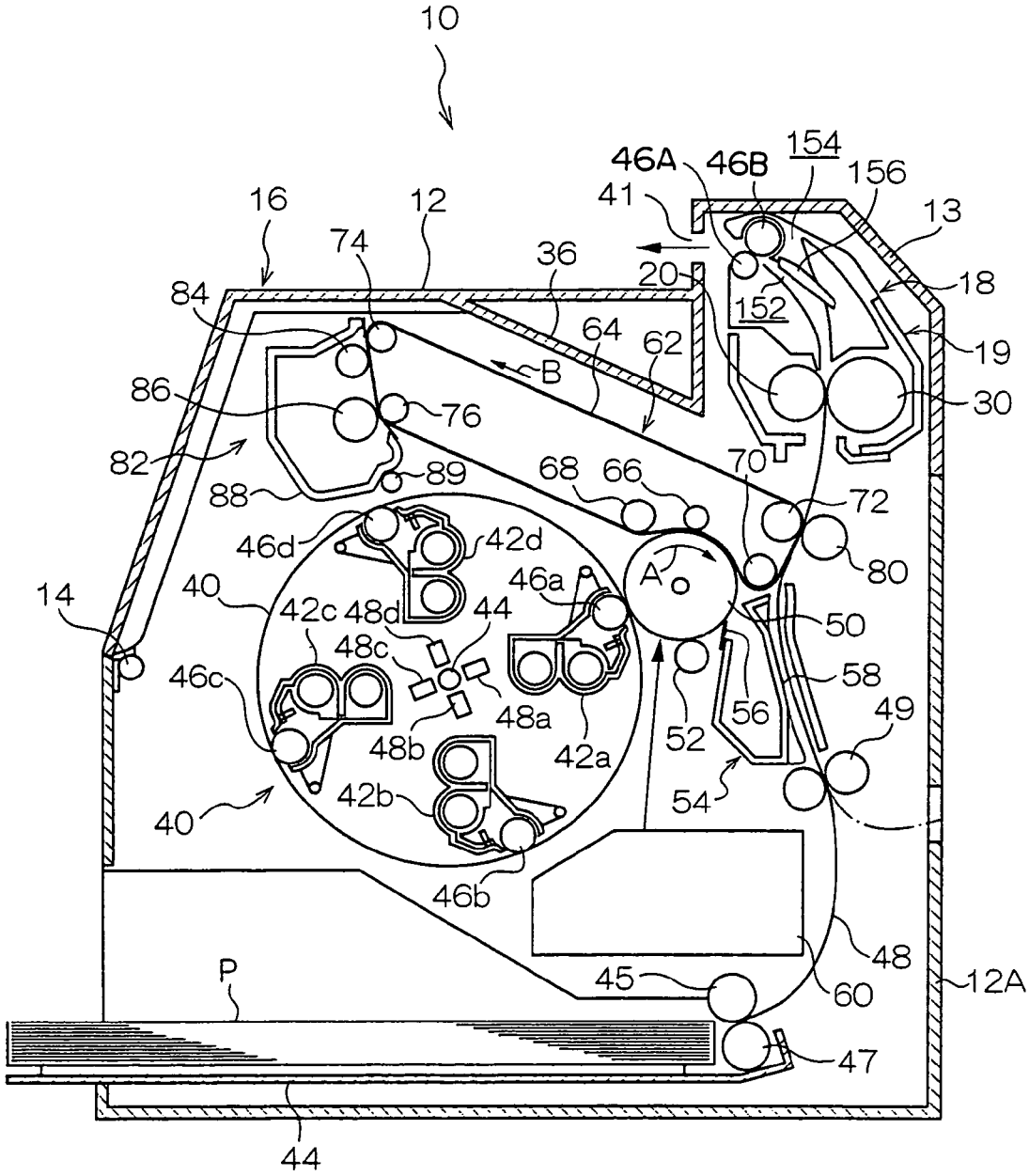
FIG. 1 is a schematic diagram of the configuration of an image forming apparatus body having a fixing device according to an embodiment of the invention.

FIG. 1 is a schematic diagram showing the configuration of an image forming apparatus 10 including a fixing device 18 according to a first embodiment of the present invention.

(Outline of Image Forming Apparatus)

As shown in FIG. 1, the image forming apparatus 10 has an image forming apparatus body 12. An opening/closing cover 16 which can be freely pivoted about a hinge 14 is arranged on the upper side of the image forming apparatus body 12.

The image forming apparatus body 12 includes a photoreceptor 50 which is rotated by a drive motor (not shown) at a predetermined rotating speed in the direction indicated by an arrow A in FIG. 1. A charging roller 52 which charges the peripheral surface of the photoreceptor 50 is arranged below the photoreceptor 50. An exposing device 60 is arranged below the charging roller 52. A laser beam is emitted from the exposing device 60 to form an electrostatic latent image on the peripheral surface of the photoreceptor 50.

A rotary developing device 40 is arranged beside the photoreceptor 50. The rotary developing device 40 has developing units 42*a* to 42*d* in which toners of colors, i.e., yellow (Y), magenta (M), cyan (C), and black (B) are stored. The toners are supplied from the developing units 42*a* to 42*d* onto the photoreceptor 50 while the developing device 40 is sequentially rotated 90°, and a full-color toner image is formed on the peripheral surface of the photoreceptor 50.

On the opposite side of the developing device 40 with the photoreceptor 50 in between, a cleaning device 54 constituted by a cleaning blade 56 and a toner collecting bottle 58 is provided. Untransferred toner left on the peripheral surface of the photoreceptor 50 is scraped away by the cleaning blade 56 and collected into the toner collecting bottle 58.

An intermediate transfer device 62 is arranged above the photoreceptor 50. The intermediate transfer device 62 includes an endless intermediate transfer belt 64. The intermediate transfer belt 64 is tensed by a lapin roll 68, a lap-out roll 70, a secondary transfer backup roll 72, a scraper backup roll 74, and a brush backup roll 76. The intermediate transfer belt 64 travels in the direction indicated an arrow B in FIG. 1 while being in contact with the peripheral surface of the photoreceptor 50 between the lapin roll 68 and the lap-out roll 70.

At a position opposite from the photoreceptor 50 with the intermediate transfer belt 64 in between, a transfer roll 66 is arranged. The transfer roll 66 transfers a toner image formed on the photoreceptor 50 to a sheet of paper P conveyed by the intermediate transfer belt 64 (primary transfer).

On the other hand, a paper feed tray 44 is arranged as a recording medium storage unit below the image forming apparatus body 12. Sheets of paper P are stored in the paper feed tray 44. A feed roll 45 and a retard roll 47 are arranged at an end of the paper feed tray 44. A sheet of paper P is fed from the paper feed tray 44 by the feed roll 45, treated by the retard roll 47, and conveyed to a conveyance path 48. The sheet of paper P is temporarily stopped by a resist roll 49 arranged on the downstream side of the feed roll 45 and the retard roll 47 in the conveyance direction, and is conveyed to a nipping portion between a secondary transfer roll 80 and a secondary transfer backup roll 72. In this case, a toner image is transferred onto the sheet of paper P (secondary transfer). The sheet of paper P is conveyed to a fixing device 18 (to be described later), and the toner image transferred onto the sheet of paper P is fixed by the fixing device 18. The sheet of paper P on which the toner image is fixed is delivered from a delivery port 41 to a delivery portion 36 arranged on the upper part of the opening/closing cover 16 by conveyance rolls 46A and 46B arranged on the upstream side of the fixing device 18 in the conveyance direction.

On the opposite side of the intermediate transfer belt 64 from the photoreceptor 50, an intermediate transfer body cleaner 82 is arranged. The intermediate transfer body cleaner 82 includes a scraper 84 and a brush roll 86. Waste toner left on the intermediate transfer belt 64 after the secondary transfer is scraped away by the scraper 84 and the brush roll 86 and collected into a toner collection bottle 88. The above process is an image forming process.

(Fixing Device)

The fixing device 18 will be described below.

Figure 2:
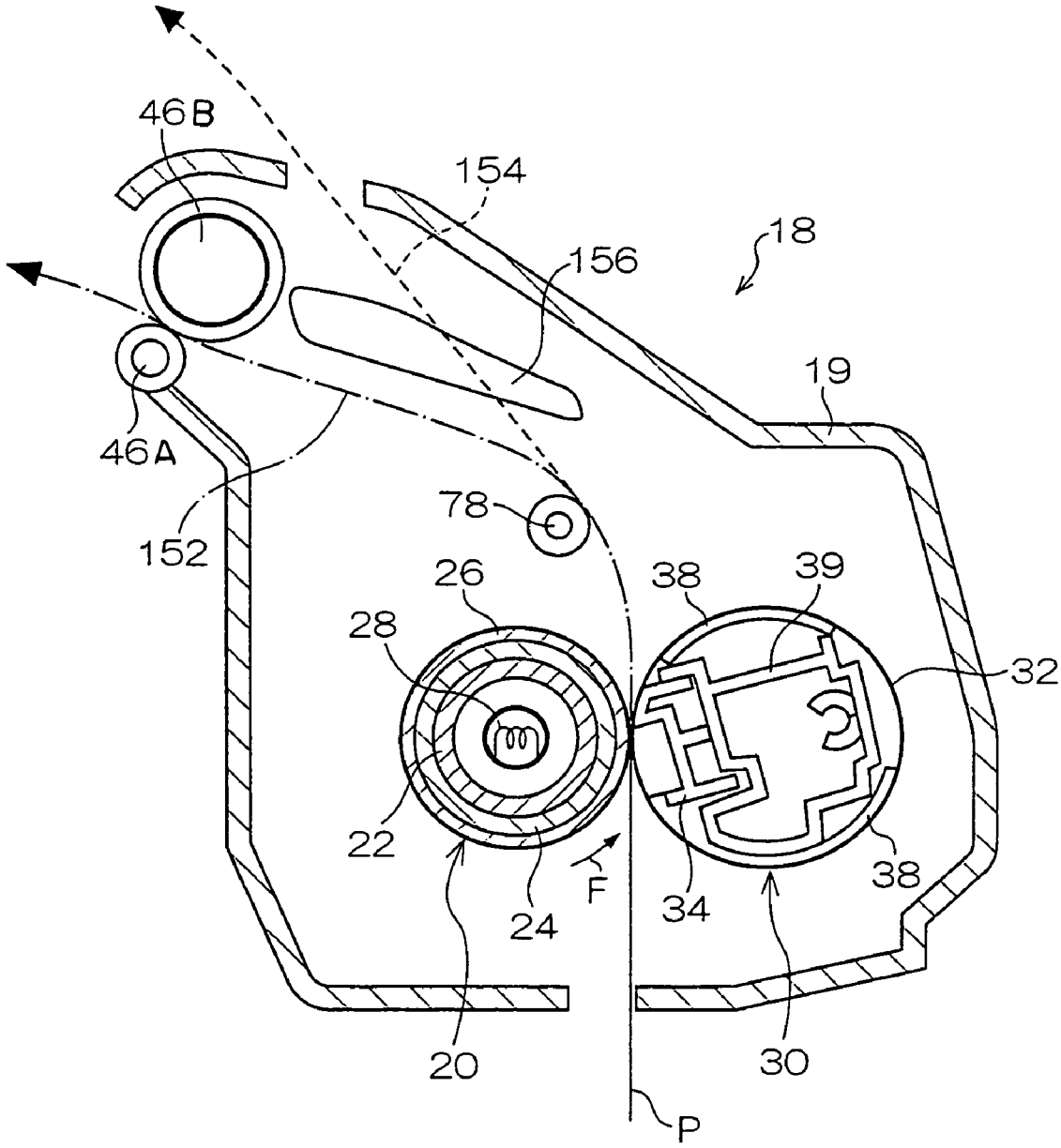
FIG. 2 is a sectional view showing the schematic configuration of the fixing device according to the embodiment of the invention.

As shown in FIG. 2, the fixing device 18 includes a housing 19. In the housing 19, a heat roller 20 heated to a predetermined temperature and a pressure roller 30 which brings a sheet of paper P into press contact with the heat roller 20 are arranged.

The heat roller 20 is formed by stacking a heat-resistive elastic layer 24 and a release layer 26 (tube consisting of PFA) having a low friction coefficient around a metal core 22 (hollow cored bar or iron or aluminum base pipe). In the heat roller 20, a halogen lamp 28 serving as a heat source is arranged.

On the other hand, the pressure roller 30 has an endless belt 32. A pressure pad 34 and a metal holder 39 which supports the pressure pad 34 are arranged inside the endless belt 32. The inner peripheral surfaces of both the ends of the endless belt 32 are supported by the peripheral surfaces of the belt traveling guides 38. The endless belt 32 is designed such that the endless belt 32 can be pivoted along the peripheral surfaces of the belt traveling guides 38.

The heat roller 20 is rotated by a drive motor (not shown) in the direction indicated by an arrow F. Due to this rotation, the endless belt 32 is driven. At this time, the sheet of paper P on which a toner image is formed is conveyed to the nipping portion between the heat roller 20 and the pressure roller 30. The toner on the sheet of paper P is melted by heat from the heat roller 20 and the pressure from the pressure roller 30 and fixed on the sheet of paper P. The sheet of paper P is guided to a traveling roll 78 arranged on the downstream side of the heat roller 20 and the pressure roller 30 in the conveyance direction, conveyed to a paper conveyance path 152 or a paper conveyance path 154 formed in the housing 19, and delivered out of the image forming apparatus body 12.

Figure 4:
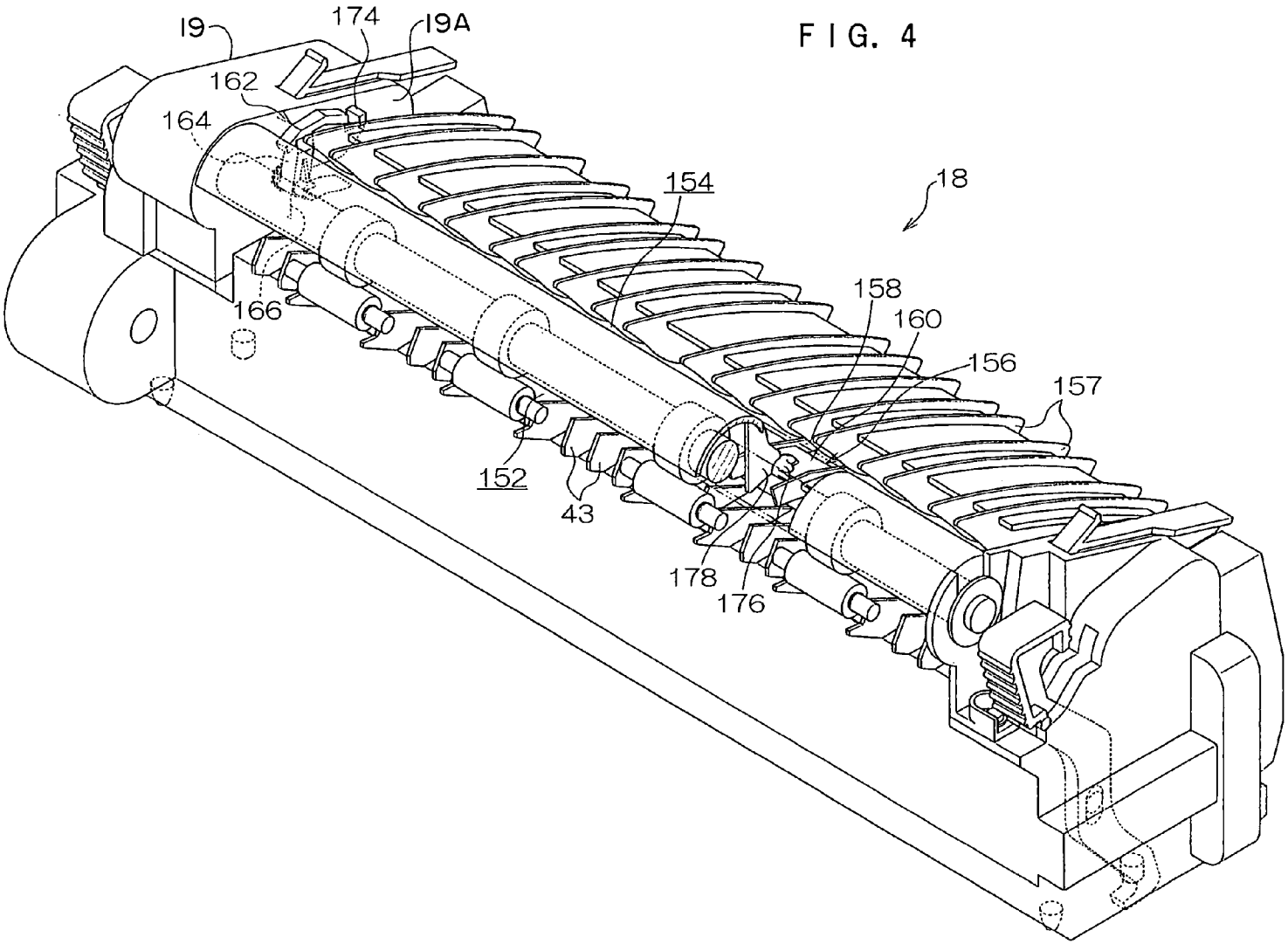
FIG. 4 is a perspective view showing the fixing device according to the embodiment of the invention.
Figure 5:
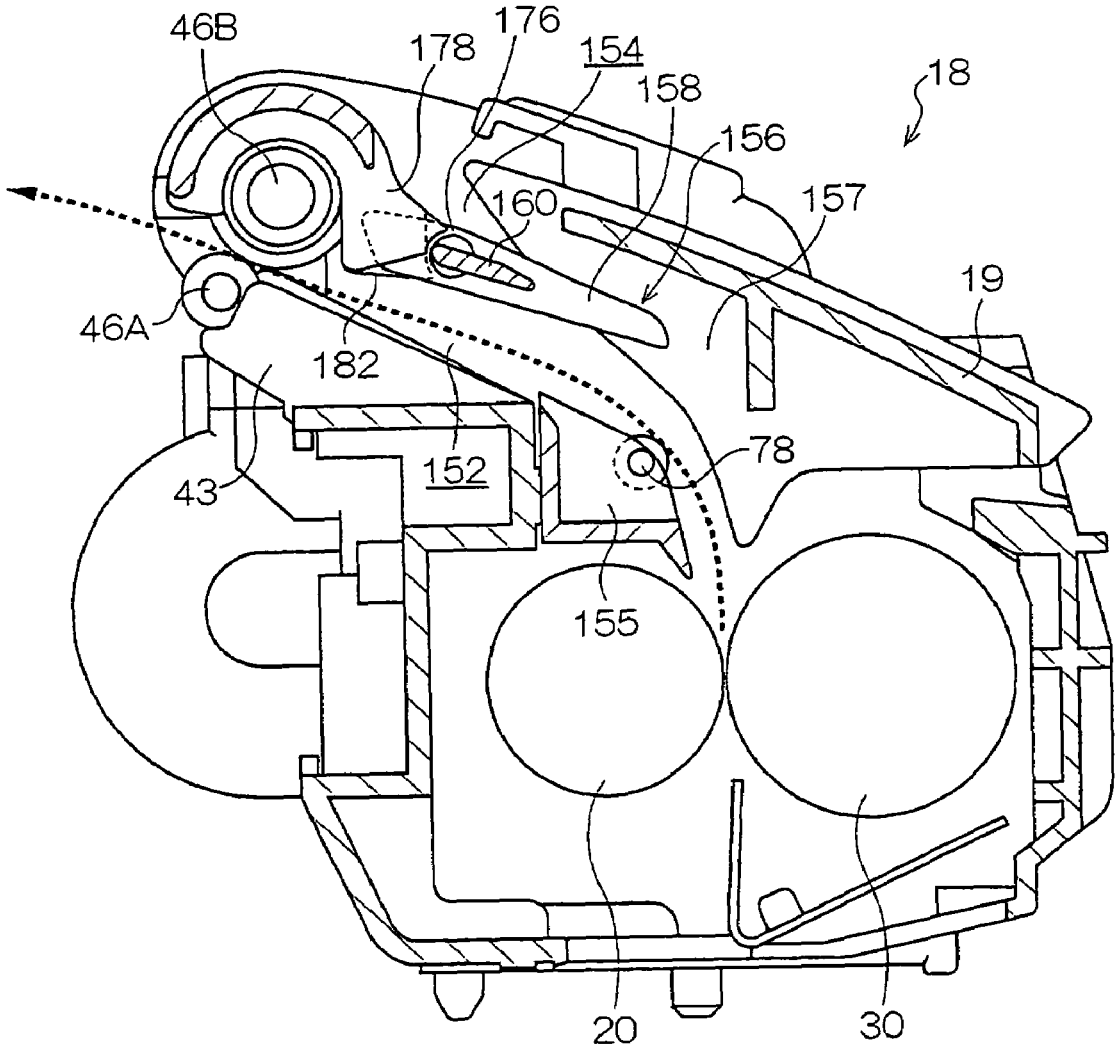
FIG. 5 is a sectional view showing a state of a gate in the fixing device according to the embodiment of the invention.
Figure 6:
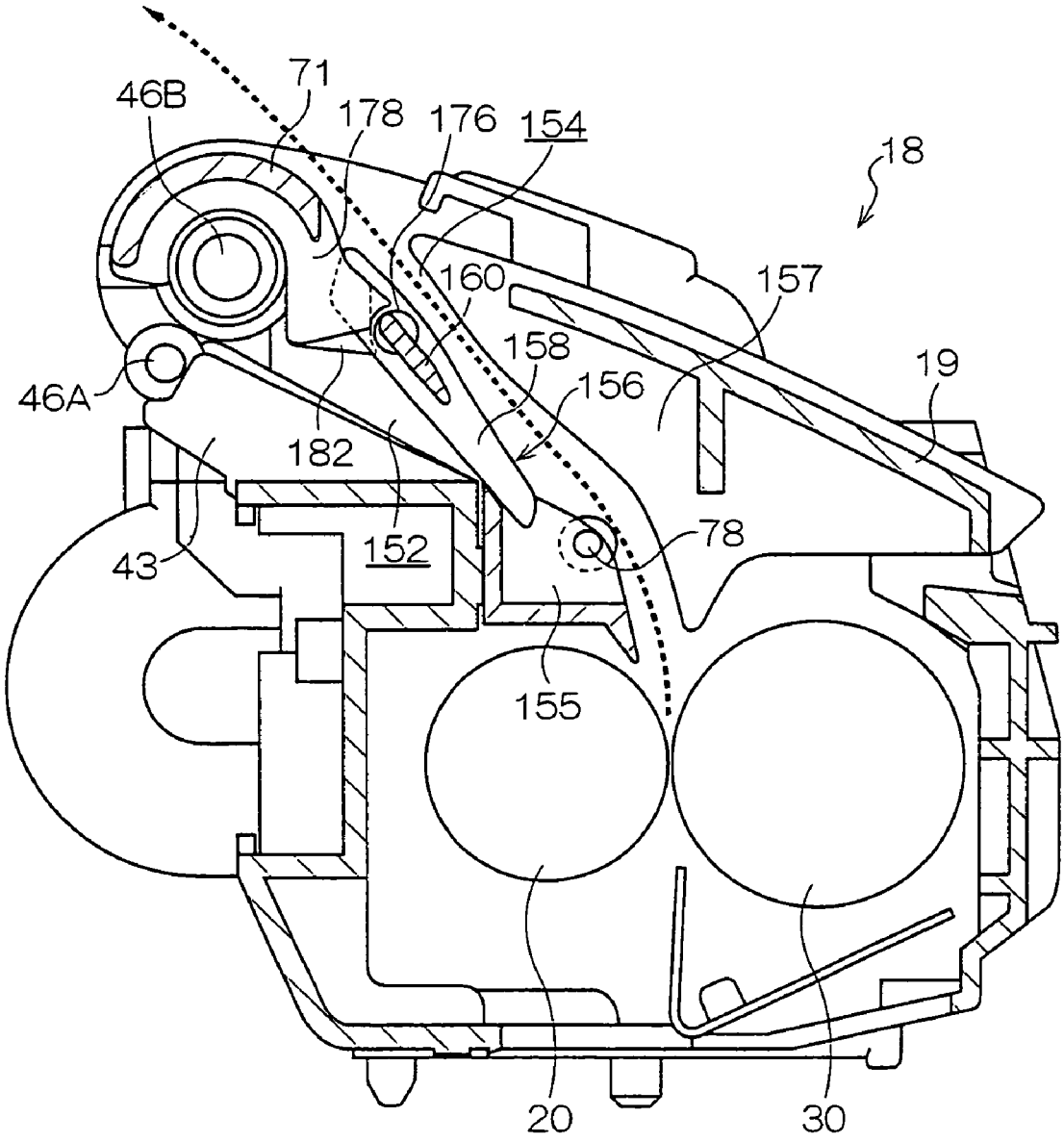
FIG. 6 is a sectional view showing a state in which the gate is pivoted in the fixing device according to the embodiment of the invention.

As shown in FIGS. 4 to 6, the lower conveyance surface of the paper conveyance path 152 is constituted by a plurality of plate pieces 155 arranged at predetermined intervals along the axial direction of the heat roller 20 on the downstream side of the heat roller 20 and a plurality of plate pieces 43 continuously extending from the plate pieces 155 along the paper conveyance path 152. In opposition to the plate pieces 155 and the plate pieces 43, and a plurality of plate pieces 157 are arranged along the axial direction of the heat roller 20 to constitute the common conveyance path.

One or more ribs 178 are arranged on the downstream side of the plate pieces 157 to constitute the paper conveyance path 154. The conveyance roll 46B is arranged at the center of the rib 178 to nip a sheet of paper P with the conveyance roll 46A arranged on the plate piece 43 side, and delivers the sheet of paper P from the paper conveyance path 152.

On the other hand, a gate 156 is arranged between the plate pieces 43 and the plate pieces 157 to form the paper conveyance path 152 and the paper conveyance path 154. The gate 156, as shown in FIG. 4, has a long plate 160 in a direction perpendicular to the paper conveyance direction of the housing 19. Boards 158 are perpendicularly arranged at predetermined intervals in the longitudinal direction of the long plate 160. Both the ends of the long plate 160 are pivotally fixed on a side wall 19A of the housing 19 of the fixing device 18.

Figure 7A:
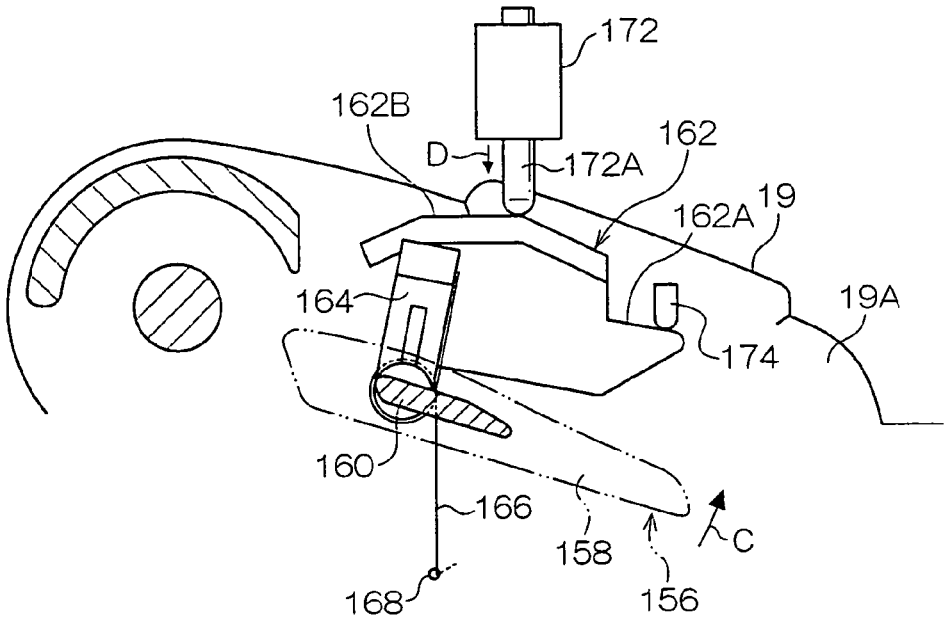
Figure 7B:
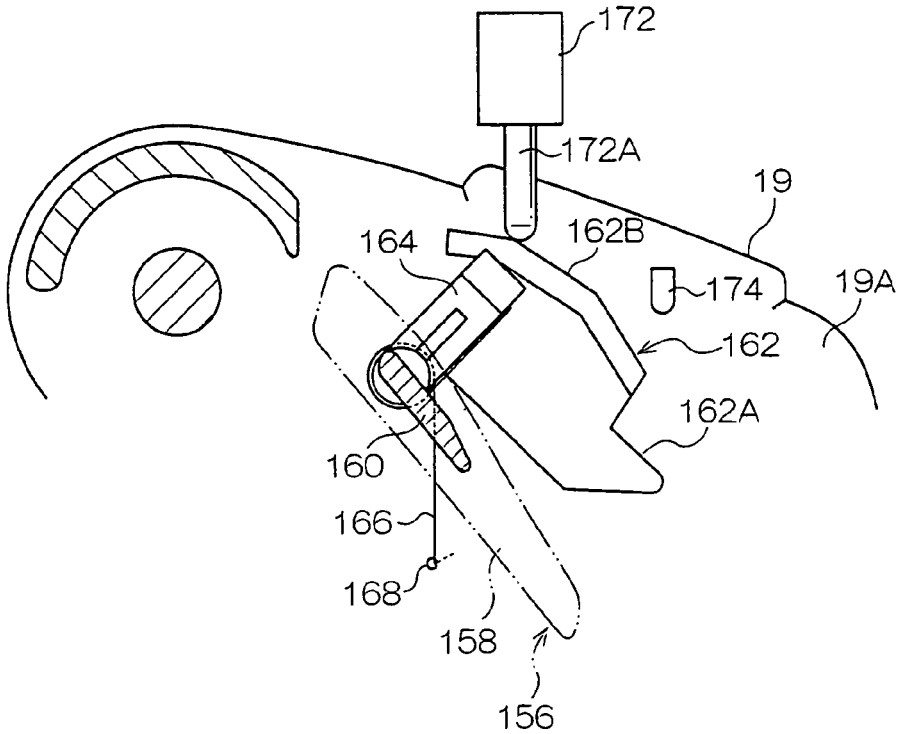

As shown in FIGS. 4, 7A, and 7B, an operation piece 162 is arranged on one end of the long plate 160 in the longitudinal direction. The operation piece 162 is almost rectangular. The operation piece 162 and the long plate 160 are connected to each other by a square column 164. A coil spring 166 is winded on the other end of the long plate 160. One end of the coil spring 166 is engaged with the square column 164. The other end of the coil spring 166 is engaged with a hole 168 formed in the side wall 19A of the housing 19. In this manner, the gate 156 is biased in the direction indicated by an arrow C. The gate 156 is tilted in a direction in which the sheet of paper P is guided to the paper conveyance path 152 (see FIG. 5) as shown in FIG. 7A when no external force is exerted on the gate 156.

When a paper reversing device 170 (to be described later) is arranged on the image forming apparatus body 12, a solenoid 172 arranged on the paper reversing device 170 is brought into contact with a top surface 162B of the operation piece 162.

The solenoid 172 is connected to a control device (not shown). When the solenoid 172 is turned on, a movable iron core 172A projects to press the top surface 162B of the operation piece 162. In this manner, the operation piece 162 is pressed downward (direction indicated by an arrow D), and the gate 156 pivots about an axis adjacent to one end of the long plate 160 in a direction opposing the direction indicated by the arrow C. For this reason, as shown in FIG. 7B, the gate 156 is tilted in a direction in which the sheet of paper P is guided to the paper conveyance path 154 (see FIG. 6).

When the solenoid 172 is turned off, the gate 156 pivots in the direction indicated by the arrow C by the biasing force of the coil spring 166. A step 162A is formed in the upper end of the operation piece 162. As shown in FIG. 7A, when the operation piece 162 is biased by the biasing force of the coil spring 166 in the direction indicated by the arrow C, the step 162A is engaged with an engaging member 174 projecting from the side wall 19A of the housing 19. For this reason, the gate 156 returns to the original position to tilt in the direction in which the sheet of paper P is guided to the paper conveyance path 152 (see FIG. 5).

Figure 8A:
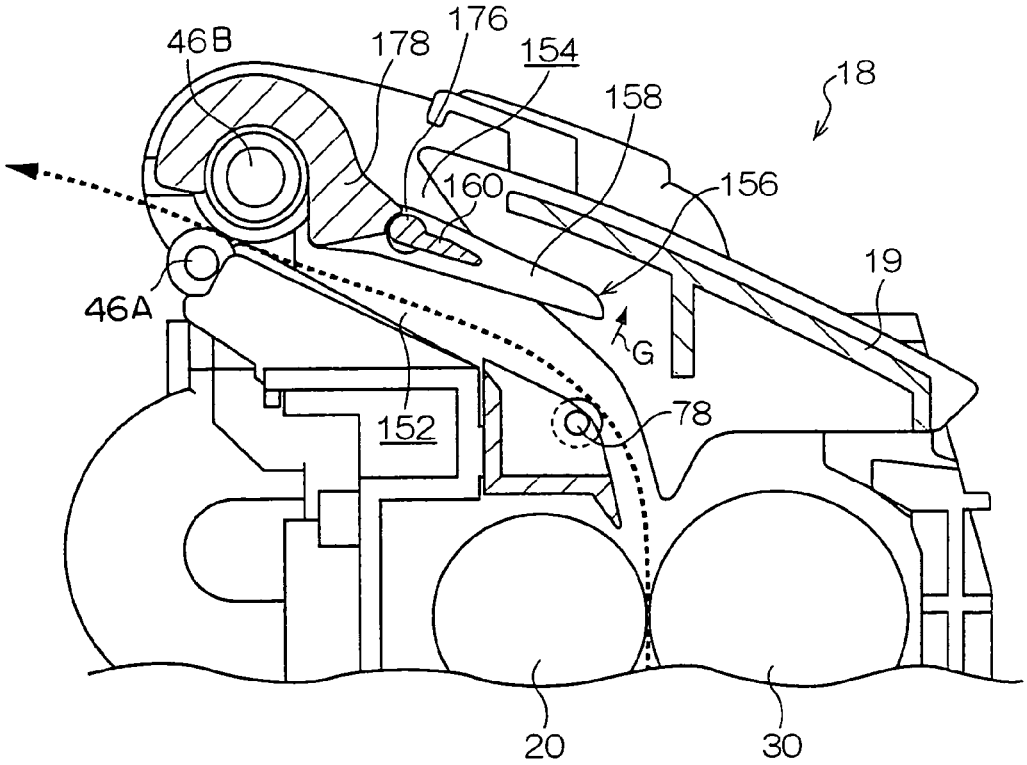

As shown in FIG. 4, projecting portions 176 are formed at predetermined intervals on the upper surface (surface of the long plate 160 facing upward when the gate 156 is loaded on the housing 19) of the long plate 160. As shown in FIG. 8A, since the projecting portion 176 is brought into contact with the rib 178 and supported by the rib 178, the long plate 160 is prevented from being deformed.

Figure 8B:
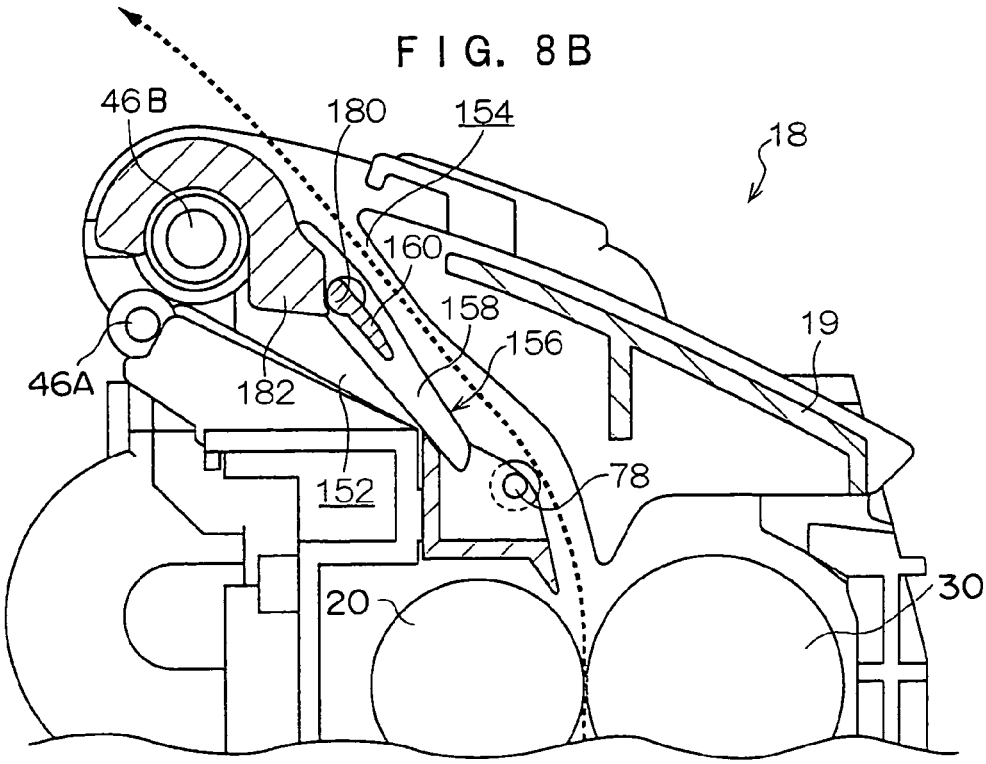

As shown in FIG. 8B, on the lower surface of the long plate 160, projecting portions 180 are formed at predetermined intervals. Since the projecting portions 180 are brought into contact with ribs 182 arranged in parallel to the ribs 178 (see FIG. 8A) and supported by the projecting portions 180, the long plate 160 is prevented from being deformed.

(Paper Reversing Device)

Figure 3:
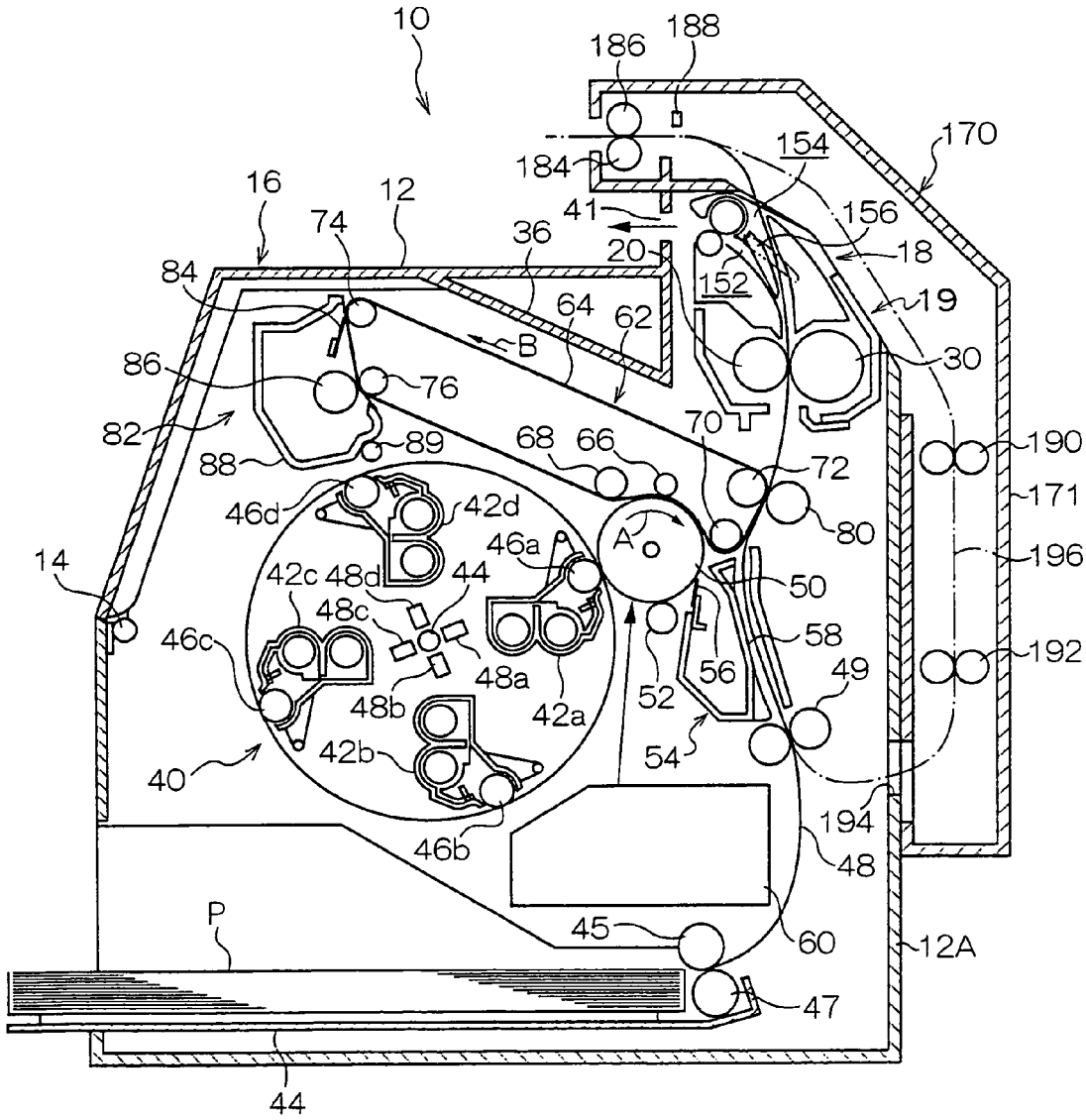
FIG. 3 is a schematic diagram of a configuration in which a paper reversing device is arranged in the image forming apparatus body having the fixing device according to the embodiment of the invention.

As shown in FIG. 3, the paper reversing device 170 can be loaded on the image forming apparatus body 12. A cover 13 (see FIG. 1) is removed from the image forming apparatus body 12, and the paper reversing device 170 is loaded.

The paper reversing device 170 has a nearly L-shaped paper reversing device body 171. A pinch roller 184 is arranged at one end of the paper reversing device body 171. A switchback roller 186 is brought into contact with the pinch roller 184 at a predetermined nip pressure. The switchback roller 186 is designed to be rotated forward or backward by a drive motor (not shown). On the upstream side of the pinch roller 184 and the switchback roller 186 in the paper conveyance direction, a sensor 188 is arranged. When the sheet of paper P sent from the paper conveyance path 154 of the fixing device 18 is received, and when the trailing end of the rear end of the sheet of paper P in the conveyance direction is detected by the sensor 188, the switchback roller 186 is rotated backward to send the sheet of paper P to a conveyance path 196.

On the downstream side of the pinch roller 184 and the switchback roller 186 in the paper conveyance direction, conveyance rollers 190 and 192 are arranged. The sheet of paper P sent to the conveyance path 196 is conveyed into the image forming apparatus body 12 by the conveyance rollers 190 and 192 through an insertion port 194 formed in the image forming apparatus body 12, and is sent to the conveyance path 48.

An operation according to a fixing device of the invention will be described below.

In simplex (single-side) printing, as shown in FIG. 1, a sheet of paper P fed from the paper feed tray 44 passes along the conveyance path 48, and the photoreceptor 50 and the fixing device 18 form an image on one surface of the sheet of paper P. The sheet of paper P is guided by the gate 156, conveyed to the paper conveyance path 152, and delivered from the delivery port 41 to the delivery portion 36 by the conveyance rolls 46A and 46B.

On the other hand, in duplex (double-side) printing, as shown in FIG. 3, the paper reversing device 170 is loaded on the image forming apparatus body 12. As shown in FIGS. 7A and 7B, the operation pieces 162 are pressed by the solenoid 172 arranged in the paper reversing device 170 to cause the gate 156 to pivot in the direction opposing the direction indicated by the arrow C. In this case, as shown in FIG. 6, the sheet of paper P on which the toner image is formed is guided by the gate 156 and conveyed to the paper conveyance path 154. As shown in FIG. 3, when the sensor 188 detects the trailing end of the sheet of paper P in the conveyance direction, the switchback roller 186 is rotated backward to send the sheet of paper P to the conveyance path 196 and to convey the sheet of paper P to the resist roll 49 through the insertion port 194. The photoreceptor 50 and the fixing device 18 form an image on the blank surface of the sheet of paper P. At this time, the solenoid 172 is in an off state, and the gate 156, as shown in FIG. 5, is tilted by the biasing force of the coil spring 166 in a direction in which the sheet of paper P is guided to the paper conveyance path 152. The sheet of paper P is guided by the gate 156, conveyed to the paper conveyance path 152, and delivered from the delivery port 41 (see FIG. 3) to the delivery portion 36 by the conveyance rolls 46A and 46B.

In this manner, since a destination of a sheet of paper P can be switched in the fixing device 18, when the sheet of paper P having one surface on which an image is formed is conveyed to the paper conveyance path 154 and sent to the paper reversing device 170, the length a conveyance path extending to the gate 156 can be shortened. Therefore, a throughput is improved. Even though another conveyance path is not formed on the downstream side of the fixing device 18, paper delivery paths can be changed depending on the types, sizes, and the like of sheets of paper because the fixing device 18 has two paper conveyance paths.

Furthermore, the gate 156 is arranged between the paper conveyance path 152 and the paper conveyance path 154 to make it possible to selectively send a sheet of paper P to the paper conveyance path 152 or the paper conveyance path 154 in the fixing device 18.

The gate 156 uses the long plate 160 as a rotating shaft to make it possible to design the fixing device 18 to be compact. In addition, since the projecting portions 176 are formed on the long plate 160 constituting the gate 156, even if the gate 156 (long plate 160) is bent by the pressure of a sheet of thick paper in conveyance, the projecting portions 176 and 180 are brought into contact with the ribs 178 and 182 arranged on the switching portion of the paper conveyance path 152 and the paper conveyance path 154 to prevent the gate 156 (long plate 160) from being damaged. Therefore, since the thickness of the long plate 160 needs not be excessively increased to secure the rigidity of the gate 156, the fixing device 18 is reduced in size.

The traveling roll 78 is arranged on the upstream side of the paper conveyance path 152 and the paper conveyance path 154 to make it possible to smoothly send the sheet of paper P to the paper conveyance path 152 or the paper conveyance path 154.

As described above in the specific embodiment, in the invention, the switching member may be a gate which is arranged between the first conveyance path and the second conveyance path (branch point) and which can be moved between the first conveyance path and the second conveyance path.

In the above configuration, the gate arranged between the first conveyance path and the second conveyance path is switched between the first conveyance path and the second conveyance path to convey a sheet of paper to the first conveyance path or the second conveyance path. More specifically, the destination of the sheet of paper is switched to the first conveyance path or the second conveyance path by the gate.

In this manner, the gate is arranged between the first conveyance path and the second conveyance path to make it possible to selectively send the sheet of paper to the first conveyance path or the second conveyance path in the fixing device.

The gate is constituted by a long plate parallel to the axis of the heating member (roll) or the pressing member (roll) and boards perpendicularly arranged at predetermined intervals in the longitudinal direction of the long plate. On the long plate, reinforcing portions, which are brought into contact with ribs arranged on the switching portion for the first conveyance path and the second conveyance path, and which serve as fixed members when the conveyance paths are switched by the gate, are formed in the vicinity of a portion of the long plate serving as a rotating shaft.

In the above configuration, on the long plate arranged parallel to the axial direction of the heating member or the pressing member constituting the gate, the boards are arranged at predetermined intervals perpendicularly to the longitudinal direction of the long plate. In addition, the reinforcing portions are formed on the long plate, and the reinforcing portions are brought into contact with the ribs arranged on the switching portion for the conveyance paths when the conveyance paths are switched.

In this manner, the gate is constituted by a long plate (thin plate) to make it possible to design the fixing device to be compact. Even if the long plate is bent by the pressure of a sheet of thick paper in conveyance, the reinforcing portions are brought into contact with the ribs arranged on the switching portion. For this reason, the gate can be prevented from being damaged. Therefore, since the thickness of the long plate need not be excessively increased to secure the rigidity of the gate, the fixing device is reduced in size.

The traveling roll which guides the recording medium to the first conveyance path or the second conveyance path, i.e., to the switching member, may be arranged on the upstream side of the first conveyance path and the second conveyance path.

The traveling roll is arranged on the upstream side of the first conveyance path and the second conveyance path to make it possible to smoothly send a sheet of paper to the first conveyance path or the second conveyance path.

Since the invention has the above configuration, the conveyance path of a sheet of paper becomes short, and a throughput can be reduced.

What is claimed is:

1. A fixing device comprising:

a heating member which is installed in an image forming apparatus, which is arranged in a housing for defining the fixing device, and which heats a recording medium onto which a toner image has been transferred to fix the image;

a pressing member which is brought into press contact with the heating member;

a first conveyance path which is formed in the housing and on which the recording medium, on which the image is fixed by the heating member and the pressing member, is conveyed;

a second conveyance path which is formed in the housing, which has a path different from the first conveyance path, and on which the recording medium, on which the image is fixed by the heating member and the pressing member, is conveyed; and a switching member which switches a destination of the recording medium to either one of the first conveyance path and the second conveyance path, the switching member placed downstream of the pressing member and the heating member in a conveyance direction of the recording medium, and formed to branch apart the conveyance direction of the recording medium from the pressing member and the heating member.

2. A fixing device according to claim 1, wherein the switching member is movably arranged between the first conveyance path and the second conveyance path and includes a gate which guides the recording medium to either one of the first conveyance path and the second conveyance path.

3. A fixing device according to claim 2, wherein the gate includes a long plate which longitudinally extends in a direction perpendicular to the conveyance direction of the recording medium and boards which are arranged on the long plate at predetermined intervals in the longitudinal direction of the long plate.

4. A fixing device according to claim 3, wherein the long plate has reinforcing portions which are brought into contact with fixed parts in the housing when the gate is located at either one of positions at which the recording medium is guided to either one of the first conveyance path and the second conveyance path.

5. A fixing device according to claim 1, wherein a traveling roll which guides the recording medium to the switching member is arranged on the upstream side of the first conveyance path and the second conveyance path.

6. The fixing device of claim 1, further comprising:

a sensor positioned along said second conveyance path to sense when a second edge of a paper has passed a location adjacent to said sensor; and a switchback roller and a pinch roller downstream of said sensor that reverses a direction of said paper after said sensor senses that said second edge has passed said location.

7. The fixing device of claim 1, wherein said switching member is positioned in said housing.

8. The fixing device of claim 1, wherein at least a part of said second conveyance path is detachable from said image forming apparatus, and said switching member is operable when said part of said second conveyance path is attached to said image forming apparatus.

9. An image forming apparatus comprising:

a toner image carrier having a surface on which a toner image is formed;

a recording medium storage unit which stores a plurality of sheets of image recording media;

a main conveyance unit which takes out one sheet of image recording medium from the storage unit and conveys the recording medium to bring the recording medium into contact with a surface of the toner image carrier on which the toner image is formed;

a transfer unit which transfers the toner image from the toner image carrier to the recording medium; and a fixing device which receives the image recording medium onto which the toner image has been transferred and fixes the toner image on the image recording medium, wherein the fixing device includes:

a heating member which is installed in an image forming apparatus, which is arranged in a housing for defining the fixing device, and which heats a recording medium onto which a toner image has been transferred to fix the image, a pressing member which is brought into press contact with the heating member, a first conveyance path which is formed in the housing and on which the recording medium, on which the image is fixed by the heating member and the pressing member, is conveyed, a second conveyance path which is formed in the housing, which has a path different from the first conveyance path, and on which the recording medium, on which the image is fixed by the heating member and the pressing member, is conveyed, and a switching member which switches a destination of the recording medium to either one of the first conveyance path and the second conveyance path, the switching member placed downstream of the pressing member and the heating member in a conveyance direction of the recording medium, and formed to branch apart the conveyance direction of the recording medium from the pressing member and the heating member.

10. An image forming apparatus according to claim 9, wherein the first conveyance path and the second conveyance path are formed to be branched apart from each other on the downstream side of the heating member and the pressing member.

11. An image forming apparatus according to claim 9, wherein the switching member is movably arranged between the first conveyance path and the second conveyance path and includes a gate which guides the recording medium to either one of the first conveyance path and the second conveyance path.

12. An image forming apparatus according to claim 11, wherein the gate includes a long plate which longitudinally extends in a direction perpendicular to the conveyance direction of the recording medium and boards which are arranged on the long plate at predetermined intervals in the longitudinal direction of the long plate.

13. An image forming apparatus according to claim 12, wherein the long plate has reinforcing portions which are brought into contact with fixed parts in the housing when the gate is located at either one of positions at which the recording medium is guided to either one of the first conveyance path and the second conveyance path.

14. An image forming apparatus according to claim 9, wherein a traveling roll which guides the recording medium to the switching member is arranged on the upstream side of the first conveyance path and the second conveyance path.

15. The fixing device of claim 9, further comprising:

a sensor positioned along said second conveyance path to sense when a second edge of a paper has passed a location adjacent to said sensor; and a switchback roller and a pinch roller downstream of said sensor that reverses a direction of said paper after said sensor senses that said second edge has passed said location.

16. The fixing device of claim 9, wherein said switching member is positioned in said housing.

17. The fixing device of claim 9, wherein at least a part of said second conveyance path is detachable from said image forming apparatus, and said switching member is operable when said part of said second conveyance path is attached to said image forming apparatus.

* * * * *